United States Patent [19]

Simonsen

[11] Patent Number: 4,728,272

[45] Date of Patent: Mar. 1, 1988

[54] ROTARY FLUID DISPLACEMENT MACHINE WITH REVOLVING WORKING CHAMBERS OF PERIODICALLY VARYING VOLUME

[76] Inventor: Knud Simonsen, Strudsbergsvej 44, DK-4200 Slagelse, Denmark

[21] Appl. No.: 808,813

[22] Filed: Dec. 13, 1985

[30] Foreign Application Priority Data

Dec. 21, 1984 [DK] Denmark ..... 6226/84

[51] Int. Cl.[4] ..... F04C 18/344; F04C 29/00

[52] U.S. Cl. ..... 418/152; 418/181; 418/260

[58] Field of Search ..... 418/3, 181, 179, 152, 418/153, 260–265, 256, 257; 417/201–203

[56] References Cited

U.S. PATENT DOCUMENTS

| | | | |
|---|---|---|---|
| 1,442,150 | 1/1923 | Hottmann | 17/40 |
| 1,811,729 | 6/1931 | Molkenbur | 418/99 |
| 1,889,822 | 12/1932 | Clapp et al. | 417/203 |
| 1,974,761 | 9/1934 | Vogel | 123/16 |
| 2,099,193 | 11/1937 | Brightwell | 418/260 |
| 3,059,862 | 10/1962 | Rich | 417/203 |
| 3,187,679 | 6/1965 | Scognamillo | 418/257 |
| 3,473,478 | 10/1969 | Little, Jr. | 418/258 |
| 3,909,158 | 9/1975 | Martin | 418/257 |

FOREIGN PATENT DOCUMENTS

| | | | |
|---|---|---|---|
| 2222324 | 11/1973 | Fed. Rep. of Germany . | |
| 2349782 | 4/1974 | Fed. Rep. of Germany | 417/203 |
| 2245875 | 4/1974 | Fed. Rep. of Germany . | |
| 1315068 | 12/1962 | France . | |
| 1547556 | 10/1968 | France . | |
| 87989 | 7/1956 | Norway . | |
| WO83/00527 | 2/1983 | PCT Int'l Appl. . | |

*Primary Examiner*—Carlton R. Croyle
*Assistant Examiner*—Jane Obee
*Attorney, Agent, or Firm*—Fleit, Jacobson, Cohn & Price

[57] ABSTRACT

In a fluid displacement machine with a rotor ring (7) rotatably supported about a fixed axis (6) and carrying a number of radially movable vanes (a–h), the latter being held in fluid-tight contact with the chamber wall (5) of the machine housing (3) by a stationary vane guide block (9), the new feature is that the vane guide block (9) is loosely supported inside the rotor ring (7), where it is held in its working position by the revolving vanes (a–h).

With this arrangement it is possible to dispense with special securing means for the guide block (9), thus making it possible to connect both ends of the rotor ring (7) (i.e. both in front of and behind the plane of the Figure) with the drive shaft (18), resulting in a considerable increase in the mechanical strength of the machine, so that it may be used for rough work, such as pumping comminuted meat containing fragments of bone.

8 Claims, 4 Drawing Figures

Figure 1:
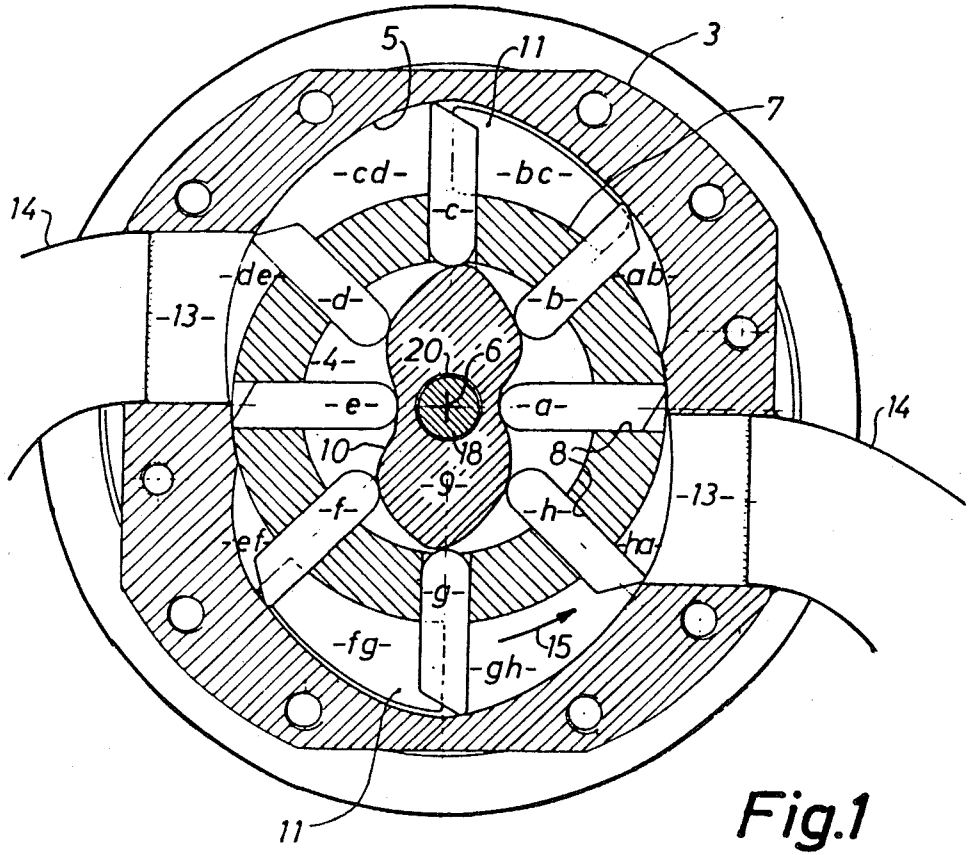

ROTARY FLUID DISPLACEMENT MACHINE WITH REVOLVING WORKING CHAMBERS OF PERIODICALLY VARYING VOLUME

The present invention relates to a rotary fluid machine of the kind comprising (a) a rotor supported for rotation about a stationary axis and with (a1) a rotor ring placed coaxially with said axis and having a number of at least partially radially extending vane or slide channels or slots, and (a2) slidably supported in each vane or slide channel or slot a vane or slide, (b) a machine housing with a housing chamber, of which the part situated outside of said rotor ring is divided into a number of working chambers of periodically varying volume by said vanes or slides, which for this purpose are in contact with or very close to the inner wall of the housing, said working chambers following the rotor ring during its rotary movement and passing at least one inlet port and at least one outlet port situated behind said inlet port in the direction of rotation, as well as (c) a cam number being substantially non-rotatable relative to the machine housing, situated within said rotor ring and shaped with a non-circular cross-section guiding surface, against which the vanes or slides may abut with the radially innermost ends and thereby be kept in contact with or very close to said inner wall of said housing.

A great number of machines of this kind are known, and they all have the feature in common that the cam number is secured to the machine housing in one way or another. The most commonly used method is to secure the cam member to one of the end walls in the machine housing, the result thereof being that the rotor ring can only be connected at one of its ends to the drive or output shaft of the machine, e.g. through a flange or disc. Considering the fact that the rotor ring is not really a ring, being divided into a number of segments by the slide channels or slots, this entails a serious limitation of the mechanical strength of the rotor ring, which may make it impossible to use a machine of the kind referred to as a pump for pumping masses containing lumps, such as comminuted meat or mincemeats containing bone fragments. The present invention is based upon the surprising realization that—provided that certain pre-conditions are fulfilled—it is not at all necessary to secure the cam member to the machine housing, and thus the machine according to the present invention exhibits the following novel features:

(d) the cam member is loosely supported between the radially innermost ends or parts of said vanes or slides, and (e) the said inner wall of the machine housing, and depending thereupon the external guiding surface of said cam member have such a shape, and said vanes or slides are present in such a number and with such an angular distribution about said axis that in each angular position of said rotor ring a force emanating from one vane or slide against the cam member tending to move said body in one direction will encounter a resistance from at least one other vane or slide, possibly tending to move said cam member in the opposite direction, all in such a manner, (f) that the cam member continually remains in one and the same position relative to the machine housing.

In such an arrangement, the cam member, instead of being rigidly secured to the machine housing, will "float" within the rotor ring, but is held in the requisite position for correct functioning by the vanes or slides, the latter in operation continually revolving or circling about the cam member. Since it is no longer necessary to secure the cam member to the machine housing, it is possible to secure the segments of the rotor ring at both ends—e.g. through a flange or a disc—to the shaft of the machine, and it will be obvious that this results in a substantial improvement of the mechanical strength of the rotor ring, so that it becomes possible to use the machine for the rough and highly demanding applications described above.

According to the present invention it is preferred that the machine has at least four vanes or slides, although a great number of vanes or slides will result in the cam member being held more securely in the operating position.

An embodiment of the machine according to the present invention, which has been tried in practice and proved as having a high mechanical strength, exhibits the further novel feature that the rotor ring is secured at each end to a supporting flange situated on a drive shaft, of which supporting flanges at least one is connected to and for rotation with the drive shaft extending through an axially extending opening through the cam member.

If, as mentioned above, the machine is to be used for pumping comminuted meat and is constructionally integrated with a delivery worm, which in more general terms may be described as a delivery pump with axial pumping, the combination of the machine according to the invention as a pump with said delivery pump with axial pumping may exhibit the further novel feature, that (a) the machine and the delivery pump share a common shaft, and (b) the common shaft with its end facing away from the delivery pump is rotatably supported in a single set of bearing means secured to the end of the machine housing facing away from the delivery pump.

With such an arrangement, the same set of bearing means may be used for supporting both the shaft of the machine itself and the adjacent end of the rotor—e.g. a worm—of the delivery pump, and at the same time the bearing means at the opposite end of the delivery rotor are utilized for supporting both the delivery rotor and the rotating parts of the machine itself.

According to the present invention, a further development of the last-mentioned embodiment exhibits the novel feature that the inlet ports are formed in a wall of the machine facing the delivery pump and being in open communication with the exit space of the delivery pump. This arrangement simplifies the construction of the combination of the two pumps, moreover facilitating the work of cleaning and sterilization, which is essential when using the combination for conveying comminuted meat.

The through-going opening in the cam member may be dimensioned for a sliding fit on the drive shaft, and in that case the drive shaft also contributes to steadying the cam member in the correct operating position.

The through-going opening in the cam member may, however, also be dimensioned with a clearance relative to the drive shaft. Such an arrangement will admittedly result in the loss of the steadying function mentioned in the preceding paragraph, but will on the other hand result in a lowering of the tolerance requirements and a reduction of the risk of a possible jamming.

With a view to a further reduction of the risk of jamming, that could be due to e.g. lumps or fibres in the medium being pumped, the cam member may consist of an elastically resilient material, such as e.g. polyamide, polyurethane or a relatively hard rubber material, preferable synthetic rubber material.

Figure 2:
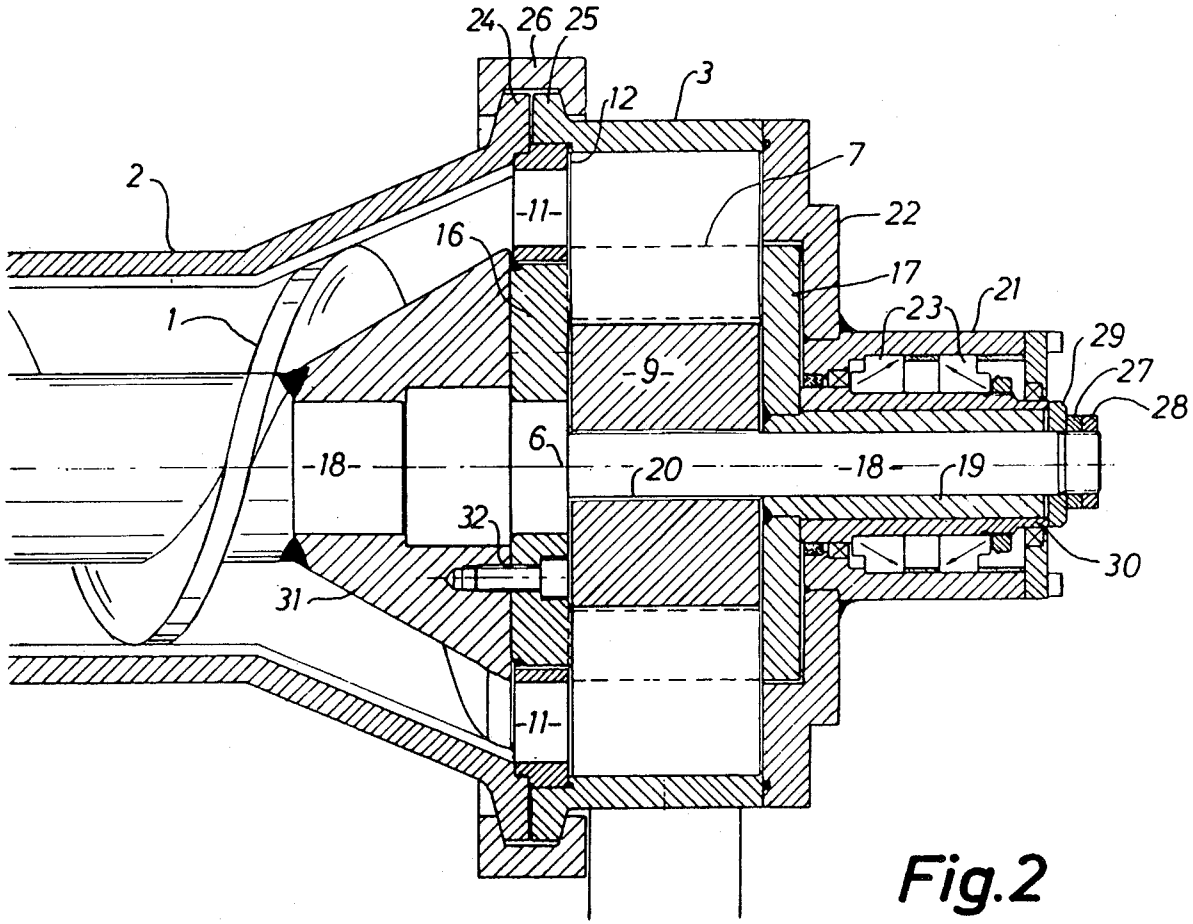
Figure 4:
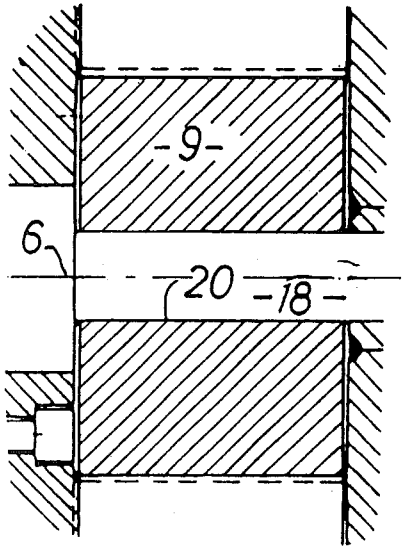
Figure 3:
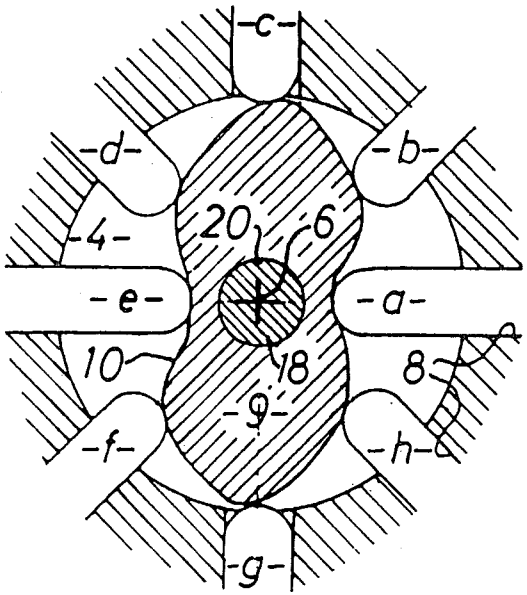

In the following, the present invention is explained in a more detailed manner with reference to the drawings, in which FIG. 1 is a radial section through the machine, FIG. 2 is an axial section through a combination of the machine and a worm conveyor, FIGS. 3 and 4 are enlarged partial sectional views, corresponding to FIGS. 1 and 2, respectively, of a modified embodiment of the machine.

The exemplary embodiment of a rotary fluid machine according to the present invention shown in the drawing is a so-called vane pump adapted to pump a thick or viscous mass, such as coarsely comminuted meat, supplied to the pump by means of a worm conveyor 1 rotating in a stationary worm housing 2.

The pump proper consists in a known manner of a pump housing 3, in which a housing chamber 4 is provided in a known manner, said housing chamber being limited outwardly by the inner wall 5 of the pump housing 3.

The inner wall 5 is not rotationally symmetrical about an axis 6 extending centrally in the housing chamber 4. A rotor consisting of a rotor ring 7 with a number—in the example shown eight—of radially extending vane slots or channels 8, in which a corresponding number of slides or vanes a–h are slidingly supported in a substantially fluid-tight manner. The rotor 7,8,a–h is rotatably supported in the housing chamber 4 with the axis 6 as its axis of rotation.

Inside the rotor ring 7 there is placed a stationary cam member 9 shaped with an outwardly facing guiding surface 10, in cross section differing from the circular shape.

In the machine's end wall 12 lying to the left in FIG. 2 there are provided two inlet ports 11, two outlet ports 13 extending through the outer wall of the machine housing 3 and hence also through the inner wall 5, and connecting the housing chamber 4 with two outlet pipes 14. As can be seen from FIG. 2, the inlet ports 11 connect the inside of the worm housing 2 to the housing chamber 4.

The part of the housing chamber 4 situated outside the rotor ring 7 is divided by the vanes a–h into a corresponding number of working chambers ab,bc, . . . gh,ha. When the rotor ring 7 rotates in the direction shown by the arrow 15, the guiding surface 10 on the cam member 9 will be held in contact with or in a quite short distance from the inner wall 5 of the machine housing 3, and the working chambers ab–ha will thus, due to the non-circular shape of the inner wall 5, in a known manner vary in volume and convey the pumping medium (not shown) from the inlet ports 11 to the outlet ports 13.

The features of the pump shown in FIGS. 1 and 2 described above are in all essentials part of the prior art. The pump shown in the drawing does, however, differ from known pumps of a similar type primarily in that the cam member 9 is not secured to the machine housing 3 or any part connected therewith, but is "floating" in the space within the rotor ring 7. Thus, an interaction takes place between the cam member 9 and the vanes a–h, as on the one hand the cam member 9 guides the vanes a–h in such a manner that at any moment they are in the correct position relative to the inner wall 5 of the machine housing 3, while on the other hand the vanes a–h, due to the sliding cooperation with the inner wall 5, maintain the cam member 9 in its correct position. This is, of course, only possible if the surfaces concerned are shaped in such a manner, that for each force from one or more vanes tending to turn the cam member 9 in one direction, there is a corresponding counterforce from one or more vanes, so that the said movement is prevented. A first condition for the attainment of this effect is that the guiding surface 10 in a radial section (and moreover in a known manner) differs from the circular shape; one could say "the more, the better". A second condition is that there is a sufficient number of vanes a–h, as otherwise there could be a risk that there was not always a vane ready to exert the said counterforce. The exemplary embodiment with eight vanes a–h shown has been succesfully tried in practice, but the effect could also be attained with a smaller number of vanes, four being, however, to be regarded as the minimum.

When now the cam member 9—unlike what is the case in previously known machines of this type—is not secured to the machine housing 3, the drawbacks previously associated with securing the cam member to the housing are avoided. This block has thus normally been secured to one of the end walls in the pump, the rotor ring having been secured to and extending cantilever-fashion from a flange secured to the drive shaft at the opposite end wall in the pump. Considering that the rotor ring is divided by the vane slots or channels into a number of segments, it can be realized that there is a limit to the load tolerated by such a pump, e.g. in the form of lumps in the pumped medium, such as pieces of bone in the meat mass supplied to the pump.

This weakening of the rotor ring 7 is, however, avoided in the pump according to the present invention, as the rotor ring is secured at both ends to a flange, viz. with its end facing left in FIG. 2 to a first supporting flange 16, and at the opposite end to a second supporting flange 17, by which the segments of the rotor ring 7 lying between the vane slots or channels 8 are secured at both ends (the manner of securing them is not shown in the drawing, as any suitable securing means, such as screws or bolts, may be used for this purpose). The two supporting flanges 16 and 17 may be secured to a drive shaft, which may be continuous, in a suitable manner. In the exemplary embodiment shown, the first supporting flange 16 is secured to a main shaft 18 also carrying the worm 1, while the second supporting flange 17 is secured to a tubular shaft 19 inserted on the main shaft 18. To enable the main shaft 18 to extend through the pump proper, an opening 20 is provided in the cam member 9. The opening 20 may be circular-cylindrical with such a diameter that the cam member 9 is rotatably supported on the main shaft 18—or rather the opposite, as the cam member 9 is stationary, and the shaft 18 rotates.

According to the present invention, it is, however, preferred to have the opening 20 as shown, i.e. where it is so much larger than the main shaft 18, that there is a certain clearance between these two parts. This makes it possible to be somewhat less strict with regard to the tolerance demands on the inner wall 5 of the housing 3, the vanes a–h and the cam member 9 proper. On the other hand, the conditions stated above for maintaining the cam member 9 stationary are to be changed by substituting "tending to move" for "tending to turn"—a condition, which may require somewhat more for it to be met, but which already has been met in the construction with eight vanes shown in the drawing.

As can be seen from FIG. 2, the tubular shaft 19 and hence also the main shaft 18 at its extreme right-hand end are rotatably supported in a bearing housing 21, secured to the second end wall 22 of the machine housing 3, by means of bearing means 23 not shown in greater detail, but which may consist of a pair of ball bearings or roller bearings, e.g. conical bearings. The worm housing 2 and the pump housing 3 have mutually facing conical flanges 24 and 25 respectively, being held together in a known manner by a peripheral clamping ring 26 being held tight in the tangential direction and hence pressing the two flanges 24 and 25 against each other. Thus, the bearing housing 21 is rigidly connected to the worm housing 2 through the second end wall 22, the pump housing 3 proper, the flanges 24 and 25 and the clamping ring 26, whereas the other end (not shown) of the worm housing 2 in a known manner may be secured to that housing or filling hopper (not shown), in which the material to be delivered by the worm 1 is placed. The requisite bearing support forces for the worm conveyor 1 are transmitted to the bearing means 23, partly through the main shaft 18 and the tubular shaft 19 placed thereon, partly through the first supporting flange 16, the rotor ring 7 and the second supporting flange 17. This provides a stable support for both the worm conveyor 1 and the rotating parts of the pump.

Since the rotor ring 7 is secured at both ends, viz. with one end to the first supporting flange 16 and with the other end to the second supporting flange 17, the rotor ring 7 is able to guide or control each and every vane a–h effectively by means of the vane slots or channels 8, even when the vanes a–h are subjected to other forces than pumping forces; thus when pumping meat mass containing lumps of bone, these lumps may enter through the inlet ports 11 and be jammed between the vertical (as shown in FIG. 1) edges of these inlet ports and a nearby vane edge. In the extremely sturdy embodiment shown, these bone lumps will, however, only be "clipped off" without any damage to the vane in question.

As mentioned above, the pump shown in the drawing is intended for use in conveying meat mass or mincemeat. For this purpose it is necessary that it be possible to dismantle, clean and sterilize the pump without too much inconvenience. In the example shown, this can be attained by removing a holding nut 27 with its associated locking nut 28 screwed onto the end of the main shaft 18, and a washer 29 situated behind these nuts 27 and 28 and abutting against a bearing sleeve 30 belonging to the bearing means 23, and opening the clamping ring 26 and hence free the two conical flanges 24 and 25 from each other. This having been done, the pump housing 3 with the bearing housing 21 and the second end wall 22 may be removed to the right in FIG. 21, after which the pump rotor consisting of the rotor ring 7, the vanes a–h and the two supporting flanges 16 and 17 may be dismantled and removed, and during this process the vane guide block 9 may also be removed. After the requisite cleaning and sterilization have been completed, the various dismantling steps are repeated in the opposite direction and order.

In an advantageous embodiment, each segment in the rotor ring 7 may be secured to the first supporting flange 16, the second supporting flange 17 only being connected to the rotor ring 7 through axially releasable plug-and-socket joints (not shown) or the like. In this way it is made possible, after having removed the housing parts 21,22 and 3 to pull the tubular shaft 19 with the second supporting flange 17 free of the main shaft 18, after which the vane guide block 9 may be pulled out along the main shaft 18. Subsequently, and if so desired, the first supporting flange 16 with the segments of the rotor ring 7 may also be freed from a conical hub 31 secured to the worm 1 and/or the main shaft 18, to which hub 31 the first supporting flange 16 is secured, e.g. as indicated by means of screws 32. Other constructions are of course possible, depending on the requirements of each application.

For conveying meat mass or mincemeat as mentioned, special sealing members between the relatively movable parts of the pump will hardly be required, as this pumping medium is rather viscous or thick. If, on the other hand, the pump is intended to be used for pumping less viscous media, possibly under high pressure, it may be necessary to place sealing members in locations, where leakage may occur.

In the foregoing, the present invention has been described with reference to an exemplary embodiment with radially sliding vanes or slides a–h for dividing the outer part of the pump housing chamber into a number of working chambers. It does, however, lie within the scope of the present invention to construct and/or situate the requisite means for dividing the pump housing chamber in other ways. Thus, it is e.g. possible to use vanes extending at a skew angle relative to the radial direction of the rotor ring 7, or instead of vanes to use cylindrical rollers, e.g. in an arrangement corresponding to the one disclosed in PCT patent application No. WO83/00527 (publication number).

For the application mentioned above, i.e. the conveying of meat mass or mincemeat, possibly with an admixture of lumps of bone, the active parts of the pump may consist of a material suited for such operation, e.g. stainless steel. For less demanding purposes it is, however, possible to use more easily workable materials, e.g. bronze, aluminum alloys or synthetic resins or other plastic organic materials. It is also possible—even for more demanding applications—to construct the vane guide block 9 from a more yielding material, such as polyamide (NYLON ®), polyurethane or the like, since the rather rough loads, to which the vanes are subjected during the "clipping-off" of lumps, will only be transmitted to the vane guide block 9 to a minor extent or not at all.

Further, the invention is not limited to the construction of the inner wall 5 of the pump housing 3 and the shaping of the guiding surface 10 on the vane guide block 9 depending thereon as shown. As an example of other possible shapes for these parts the attention is drawn to the construction disclosed in the German Offenlegungsschrift No. 2.245.875, comprising an oval-shaped vane guide block 22 with straight sides and rounded ends.

I claim:

1. A rotary fluid machine of the kind comprising (a) a rotor supported for rotation about a stationary axis and with (a1) a rotor ring placed coaxially with said axis and having a number of at least partially radially extending vane slots substantially equally angularly distributed about said stationary axis, and (a2) slidably supported in each vane slot a vane, (b) a machine housing with a housing chamber of a non-circular cross-sectional shape, a part of which is situated outside of said rotor ring and is divided into a number of working chambers of periodically varying volume by said vanes, which for this purpose are in substantially fluid tight engagement with the inner wall of the housing, said working chambers following the rotor ring during its rotary movement and passing in succession at least one inlet port and at least one outlet port, as well as (c) a substantially rigid cam member situated non-rotatably within said rotor ring and shaped with a non-circular cross-section guiding surface, against which the vanes may abut with their radially innermost ends and thereby be kept in said substantially fluid tight engagement with said inner wall of said housing, wherein (d) the cam member is supported concentrically with said rotor ring and in a floating manner between the radially innermost ends of said vanes, and wherein (e) said vanes are present in a number of at least four.

2. A machine according to claim 1, wherein said machine includes at least two inlet ports and the inlet ports are formed in a wall of the machine facing a delivery pump and being in open communication with an exit space of the delivery pump.

3. A machine according to claim 1, wherein the cam member consists of an elastically resilient material, such as e.g. polyamide, polyurethane or a relatively hard rubber material, preferably synthetic rubber material.

4. A machine according to claim 1, wherein there are eight vanes.

5. A machine according to claim 1 or claim 4, wherein the rotor ring is secured at each end to a supporting flange situated on a drive shaft, of which supporting flanges at least one is connected to and for rotation with the drive shaft extending through an axially extending opening through the cam member.

6. A machine according to claim 1 and constructionally integrated with a delivery pump with axial pumping, wherein (a) the machine and the delivery pump share a common shaft, and (b) the common shaft with its end facing away from the delivery pump is rotatably supported in a single set of bearing means secured to the end of the machine housing facing away from the delivery pump.

7. A machine according to claim 6, wherein an opening through the cam member is dimensioned for a sliding fit on the common shaft.

8. A machine according to claim 6, wherein an opening through the cam member is dimensioned for a clearance relative to the common shaft.

* * * * *